United States Patent [19]

Gatewood

[11] Patent Number: 4,890,845

[45] Date of Patent: Jan. 2, 1990

[54] GAME APPARATUS WITH ROTATING ELEMENTS

[76] Inventor: Sidney Gatewood, 25170 Waldorf, Roseville, Mich. 48066

[21] Appl. No.: 284,598

[22] Filed: Dec. 15, 1988

[51] Int. Cl.[4] ..... A63F 3/00

[52] U.S. Cl. ..... 273/271; 273/143 E; 273/281; 273/DIG. 26

[58] Field of Search ..... 273/264, 271, 281, 143 E, 273/DIG. 26

[56] References Cited

U.S. PATENT DOCUMENTS

| | | | |
|---|---|---|---|
| 1,087,797 | 2/1914 | Lowe | 273/281 |
| 2,628,838 | 2/1953 | Smalley | 273/271 |
| 3,410,011 | 11/1968 | Bowman . | |
| 3,599,977 | 8/1971 | Glass . | |
| 3,797,829 | 3/1974 | Heller | 273/271 |
| 4,285,522 | 8/1981 | Turner | 273/271 X |

FOREIGN PATENT DOCUMENTS

| | | | |
|---|---|---|---|
| 760939 | 12/1931 | France | 273/271 |
| 2584301 | 1/1987 | France | 273/281 |
| 452420 | 5/1968 | Switzerland | 273/281 |
| 353167 | 7/1931 | United Kingdom | 273/143 E |

*Primary Examiner*—Anton O. Oechsle

*Attorney, Agent, or Firm*—Krass and Young

[57] ABSTRACT

A game apparatus comprising a plurality of spherical members, a frame member and detent means for biasing the rotation of the spherical members is disclosed herein. Each spherical member has an axle projecting from it and includes a plurality of indicia disposed about an equatorial periphery thereof. The frame member includes a plurality of stations configured to receive one of the spherical members. The frame member further includes bearing means for supporting the axle of the spherical member so that the spherical member is rotatable in its station. The rotation of the spherical member allows for a player to select a particular display of indicium located on the spherical member. The game apparatus further includes a detent means for biasing the rotation of the spherical member to a preselected position, the position corresponding to a particular display of indicium.

18 Claims, 2 Drawing Sheets

GAME APPARATUS WITH ROTATING ELEMENTS

FIELD OF THE INVENTION

This invention relates to games, and more particularly to a game apparatus having a plurality of spherical members defining different displays of indicia and mounted in unique stations encompassed within a frame member.

BACKGROUND OF THE INVENTION

The game of tic-tac-toe and its many variations has been enjoyed by children and adults through many generations. Countless number of hours have been spent playing the game at home, at schools during recess hours and while traveling in a car during extended trips. The game has been played using a variety of different objects ranging from sticks in sand, chalk on sidewalks, pencil and paper and recessed boards with movable objects. Handheld computerized versions of the game are now available.

Other variations in playing the game of tic-tac-toe include games wherein the "X's" and "O's" are included on movable objects within a frame boundary. The player simply taps one edge of the member within the frame to expose either the X or the O. For example, Pat. No. 2,628,838, Feb. 17, 1953 to Smalley discloses a rotary block game apparatus wherein rotatable, triangularly shaped blocks are contained within a frame member. The three-sided blocks rotate about an axle projecting from a triangularly shaped hole in a side of the blocks. The facings of the sides of the blocks have different displays corresponding to either an X, an O, a neutral display or other variations of designs depending upon which game is chosen to be played. A player taps the side of the block to cause the block to rotate to the desired display.

U.S. Pat. No. 3,599,977, issued Aug. 17, 1971, discloses a similar game apparatus, more familiarly known by its trademark "Toss Across," wherein triangularly shaped members are contained within a frame. The triangularly-shaped members also have three sides, each of which has either an X, an O, or a neutral position. A player throws a "bean-bag" projectile at the neutral position in order to cause the triangularly shaped member to rotate to the X or the O position. The triangularly shaped block has a detent means which prevents the triangularly shaped block from rotating more than 240° around the axis of rotation. A pin extends laterally outwardly from one of the side walls of the triangularly shaped member to prevent the movement of the block through the arc greater than 240 °.

U.S. Pat. No. 3,410,011, issued Nov. 12, 1968 to Bowman discloses a display unit which includes a frame carrying an array of perpendicularly disposed display elements. The display elements are mounted in the frame so as to rotate about a number of different display positions. The displays are retained in the display position by a detenting means carried by a rear wall of the frame. The display elements rotate about an axis and are fixed into the display position by the detenting means which is typically a resiliently deformable material located behind the display element and which engages the corners of the elements. Bowman further discloses a detenting means wherein a backing plate of rigid plastic engages tabs provided on the display elements.

Each of the above related art references, however, is limited in that only one variation of a game can be played and the game can only be played from one side, the top side of the game. It is also possible in each of the above references that pieces of the games, such as the bean-bag projectiles, become lost, the detenting means become dislodged from the frame member or the display elements become dislodged from the frame member so that the game is useless. The games are also not small enough or transportable enough to be played within the interior of an automobile or the like.

It will thus be appreciated that there is yet a need for a self-contained game apparatus with rotatable display elements contained within a frame member wherein the rotatable elements rotate 360° through an axis of rotation so that many variations of games can be played without a player losing interest. The display elements are visually perceptible from either the top side or the bottom side of the frame element and contain displays of indicia and detenting means which allow the display elements to be rotated into a display position and secured there while the game is played. When the game is finished, the frame member is simply turned over to display a neutral side so that a new game can be played. The game is transportable in that there are no loose pieces and the displays are easily changed. The game is economical to produce and is capable of withstanding years of playing.

SUMMARY OF THE INVENTION

There is disclosed herein a game apparatus which comprises a plurality of spherical members mounted within a frame member. Each spherical member has an axle projecting from it and includes a plurality of indicia disposed about an equatorial periphery thereof. The spherical members rotate about an axis of rotation parallel to the axle. The game apparatus further comprises a frame member which includes a plurality of stations each configured to receive one of the spherical members. The frame member further includes bearing means for supporting the axle so that the spherical member is rotatable in its station. The rotation of the spherical member allows for a player to select a particular display of indicium located on the spherical member. The game apparatus further includes detent means for biasing the rotation of the spherical member to a preselected position, the position corresponding to a particular display of indicium.

A further embodiment is disclosed wherein the spherical members define hollow chambers which include at least two contiguous portions thereof. The portions each correspond to a unique display of indicium. Detent means is also disclosed comprising a ball disposed in the chamber and which is translatable from one portion of the chamber to another, the translation of the ball caused by the rotation of the spherical members. The translation of the ball into one portion of the chamber causes the spherical member to remain in a fixed display position until the spherical member is rotated again.

DETAILED DESCRIPTION OF THE PREFERRED EMBODIMENT

Figure 1:
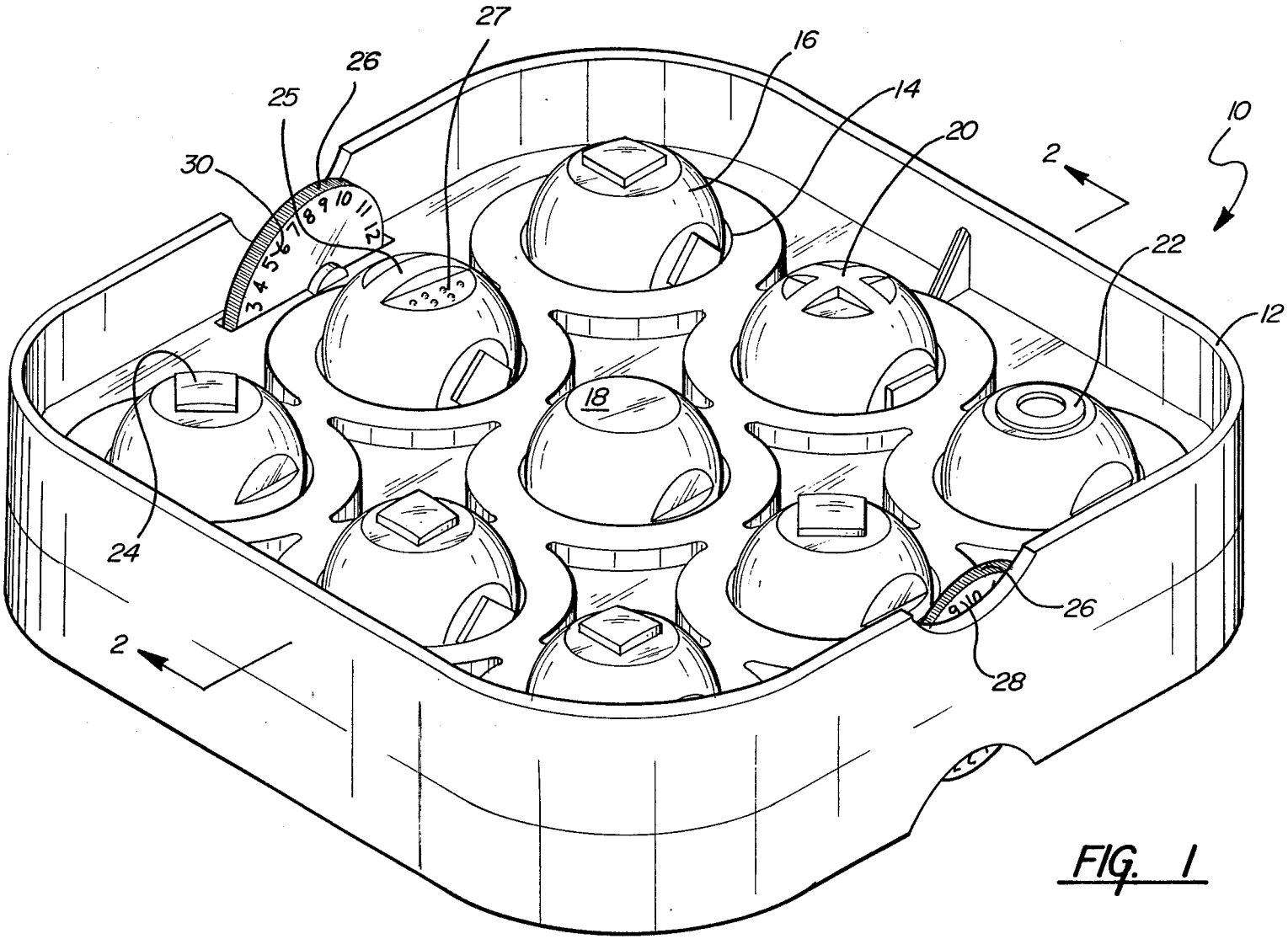
FIG. 1 is a perspective view of a game apparatus with rotating elements structured in accord with the principles of the present invention.

Referring to the drawing, FIG. 1 is a perspective view of a game apparatus 10 with rotating spherical members 16 contained within a frame member 12. Frame member 12 includes a plurality of stations 14, each station 14 configured to receive one of the spherical members 16 therein. Frame member 12 may be fabricated from a variety of materials, most preferably from synthetic polymeric materials. In the preferred embodiment of the invention, frame member 12 and the plurality of stations 14 formed integral therewith are fabricated by an injection molding process. Frame member 12 defines an upper half and a reversely identical lower half which are joined in back-to-back mating position after the spherical members 16 have been placed in their respective stations 14. The upper and lower halves of frame member 12 are then permanently secured to one another in any of a number of conventional ways.

As shown in FIG. 1, the plurality of stations 14 and the spherical members 16 contained therein are arranged in a 3×3 matrix wherein the rows are perpendicularly disposed to the columns. However, larger matrices, such as 4×4, 5×5, 8×8 or even larger may be formed in like manner for playing a variety of possible games; and obviously, the rows and columns need not be mutually perpendicular. The 3×3 matrix shown in FIG. 1 is meant only as an example thereof and not a limitation upon the present invention.

Game apparatus 10 further comprises a plurality of spherical members 16, each member 16 having an axle (shown at 40 in FIG. 2) projecting therefrom. The spherical members 16 rotate 360° about an axis of rotation parallel to the axle projecting therefrom. Each spherical member 16 includes a plurality of indicia disposed about its equatorial periphery. The plurality of indicia disposed on the spherical member 16 may take many shapes and forms. For example, a spherical member 16 with different displays of indicia may define an "X" indicium 20, and "O" or circle indicium 22, a diamond-shaped indicium 24, a minus-shaped indicium 25 or a neutral indicium 18 disposed about its peripheral equatorial axis. Since spherical members 16 rotate 360° about an axis of rotation, an almost infinite number of possible displays may be disposed thereupon. The number of displays, however, will be limited by the detent means employed on the game apparatus as will be more fully described below. However, many variations of displays may be employed other than those specified above, such as letters of the alphabet, numbers, different colors or animal shapes and figures which can be used as learning tools by young children. The displays on spherical members 16 may also be provided with indented surfaces or raised tactile symbols 27, such as Braille lettering, so that the game can be played and enjoyed by the sight impaired as well.

Game apparatus 10 further includes counter means 26 which operates to keep a player's score. The characters 28 on counter 26 increment the number of wins or points a player achieves during any specific game, or the number of successful rows or columns the player captures in other specified games. In the FIG. 1 embodiment, the counter means 26 is a disk-shaped member secured to frame member 12 and which rotates 360° through an axis of rotation. The counter means 26 defines reversably opposed, characters which may be painted, embossed or lettered onto the disks. A player can determine an opponent's score by reading the reversely embossed characters 30 on the opposing player's disk.

Figure 2:
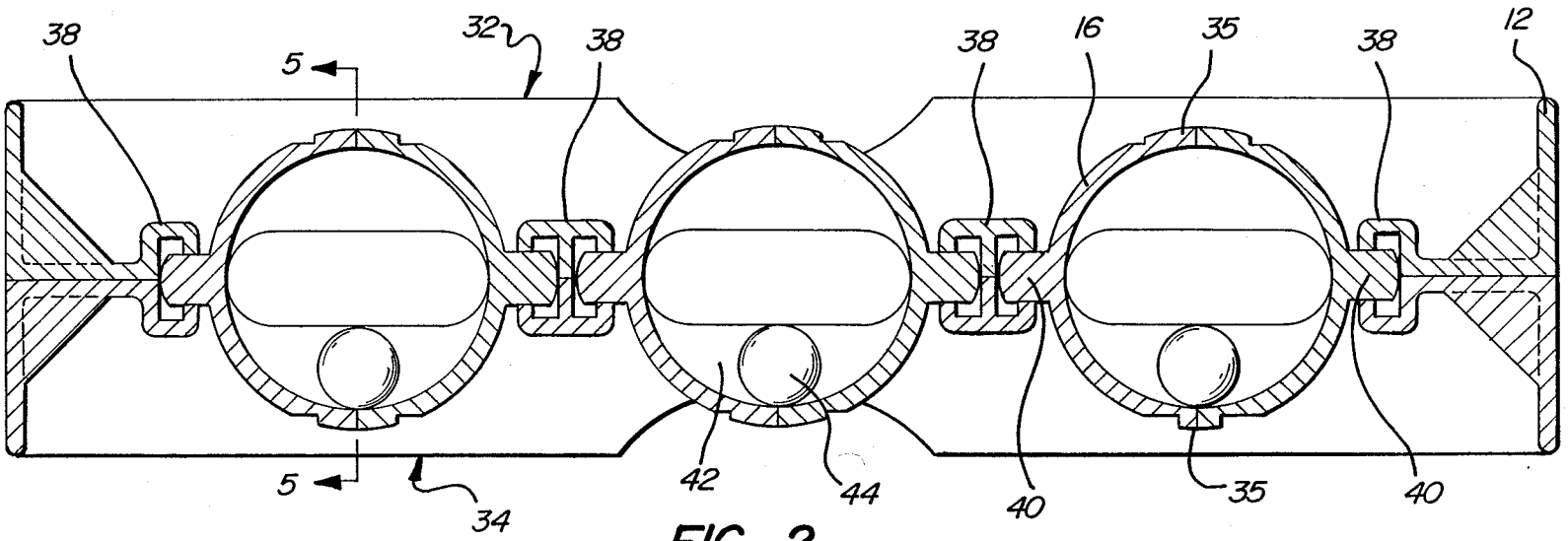
FIG. 2 is a cross-sectional view of the game apparatus of FIG. 1 taken along the line indicated at 2—2.

Referring now to FIG. 2, there is shown a cross-sectional view of one row of spherical members of game apparatus 10 in FIG. 1 taken along the line indicated at 2—2. As shown in FIG. 2, spherical members 16 have an axle 40 projecting from each side thereof. The axle 40 defines the axis of rotation through which spherical member 16 rotates. Frame member 12 further defines a top side 32 and a bottom side 34 such that the displays 35 of indicia on spherical members 16 may be viewed from either the top of the frame member 12 or the bottom of the frame member 12 when the frame member is turned over. Frame member 12 further includes bearing means 38 integral therewith for receiving and supporting the axle 40 of the spherical members 16 so that the spherical member 16 is rotatable in its corresponding station.

Spherical member 16 is preferably formed of a synthetic polymeric material through an injection molding process wherein an upper half of spherical member 16 is fabricated and then joined to an already fabricated lower half. The two halves are permanently joined using conventional processes employing adhesives, thermal bonding or ultrasonic bonding. In the preferred embodiment, the upper and lower halves of spherical members 16 are fabricated with press fit pins and holes (shown at 61 in FIG. 4 and at 81 in FIG. 5) so that the upper half of spherical member is simply press fit to its corresponding lower half to form the whole spherical member. The spherical members 16 are then placed in their respective stations, their axles 40 projecting into and being supported by the bearing means 38 for rotation thereabout. Other conventional materials, such as metals and wood and their corresponding fabrication processes may be used to manufacture spherical members 16.

As shown in FIG. 2, and as will be more fully explained with reference to FIG. 3 hereinbelow, spherical member 16 is at least partially hollow and defines an internal chamber 42. The chamber includes at least two contiguous portions, with each portion corresponding to a unique display of indicia. The internal chambers, in combination with a rolling ball 44 contained therein, are one embodiment of a detent means used to secure the spherical member 16 into a unique display position. However, in accord with principles of the present invention, spherical member 16 may be fabricated without the internal chambers defined therein, in which case the detent means may include a pin contained on said axle 40 of the spherical member 16 and matingly engageable with a tab located in the bearing means 38. The pin engages the tab at each unique display of indicia when said spherical member is rotated about its axis of rotation through a given degree of rotation.

Figure 5:
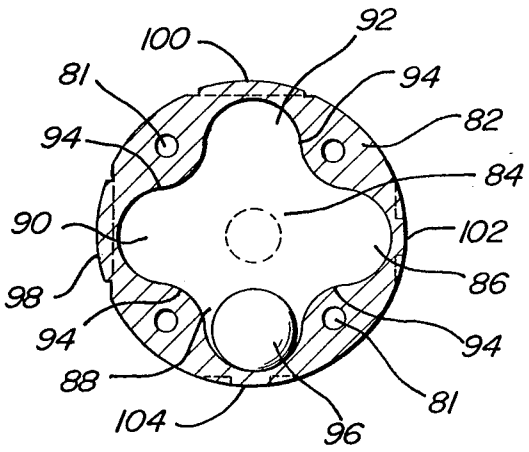
FIG. 5 is a cross-sectional view of an alternative embodiment of a rotating element of a game apparatus of FIG. 1, taken along the line indicated at 5—5 of FIG. 2.
Figure 4:
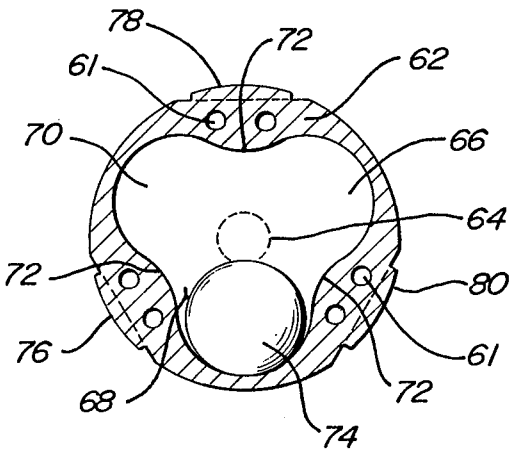
FIG. 4 is a cross-sectional view of another embodiment of a rotating element of a game apparatus of FIG. 1.
Figure 3:
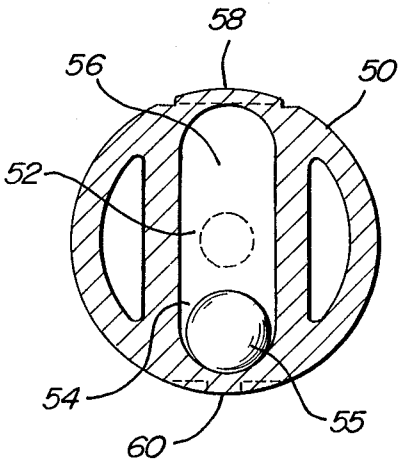
FIG. 3 is a cross-sectional view of one embodiment of a rotating element of a game apparatus of FIG. 1.

FIGS. 3, 4 and 5 are cross-sectional views of alternative embodiments of the spherical members of a game apparatus of FIG. 1. As explained above, the spherical members in FIGS. 3, 4 and 5 are all at least partially hollow and define chambers therein. In FIG. 3, spherical member 50 defines an internal chamber 52 which includes two contiguous portions 54,56. Each portion 54,56 corresponds to a unique display of indicia 58,60, respectively. The internal chamber 52, in combination with ball 55 contained therein, is the detent means for the spherical member 50. Ball 55, disposed in chamber 52, is translatable from one portion 54 of chamber 52 to another portion 56 of the chamber 52. The translation of ball 55 is caused by rotation of spherical member 50 about its axis of rotation. Ball 55 can be fabricated from steel, glass, high density rubber or other synthetic polymeric materials having sufficient weight to maintain spherical member 50 in the desired display position.

When a player desires the display of indicium 60 to be visible from the top side of the frame member, the player simply rotates spherical member 50 180° so that ball 55 translates from interior portion 54 to portion 56. Display 60 is now visible from the top of the frame member. Spherical member 50 with two displays of indicia may be employed in a variety of games ranging from a type of checkers to a game commonly known by its trademark "Othello®" or more commonly known as "Flip-It." Other unique variations of games can be invented by the players.

FIG. 4 shows a cross-sectional view of spherical member 62 defining an interior chamber 64 having three contiguous portions 66,68,70 contained therein. Each interior portion corresponds to a unique display of indicium 76,78,80, respectively. As in FIG. 3, the detent means further comprises a ball 74 which translates from one portion to another corresponding to the rotation of spherical member 62. Each of the interior portions 66,68,70 include ridges 72 which are generally perpendicular to the equatorial periphery of the spherical member 62. The number of ridges 72 of each portion correspond to the number of displays of indicium. Ball 74 remains between ridges 72 which hold ball 74 in place until spherical member 62 is rotated.

Spherical member 62 in FIG. 4 has three displays of indicia 76,78,80 which are disposed about the equatorial periphery of the spherical member 62 spaced equidistantly at 120° intervals. The displays of indicia are different, the first display of indicium 76 being of a first design, the second display 78 being of a second design, and the third display 80 being of a third design. For example, the first display of indicium 76 may be an "X," the second display 78 may be a "O," and the third display 80 may be a neutral display neither indicating an X nor an O. In this manner, tic-tac-toe may be played wherein the neutral displays are all visible from the top of the frame member and a player simply rotates the spherical member 120° to his appropriate X or O. Other obvious variations of the displays of indicia may be chosen.

FIG. 5 shows a cross-sectional view of a spherical member 82 taken along the line 5—5 of FIG. 2. Spherical member 82 defines an internal chamber 84 having four contiguous portions 86,88,90,92 therein. As before, the detent means further includes a ball 96 which is translatable from one portion to another corresponding to rotation of the spherical member about its axis of rotation. Each of the interior portions contains a ridge 94 generally perpendicular to the equatorial periphery of the spherical member and which, as stated previously, maintains the ball in the interior portion corresponding to the visible display position.

Spherical member 82 contains four displays of indicia 98,100,102,104 corresponding respectively to the four interior portions 86,88,90,92. The first display of indicium 98 is of a first design, the second display 100 is of a second design and the third and fourth displays 102, 104 are of a third design. The first 98 and second 100 displays of indicia are spaced at 90° intervals from one another while the third and fourth displays 102, 104 are spaced at 180°intervals from the first 98 and second 100 displays, respectively. In the preferred embodiment, the third and fourth displays are always of a neutral design so that when the first 98 or second 100 design is visible from the top of the frame member, the neutral design is visible from the bottom of the frame when the frame is turned over.

In this embodiment, the game board can be reset without turning each individual sphere to a neutral position. When the chamber of a spherical member includes two or more contiguous portions (in multiples of two), in combination with a detenting ball and having display indicia and neutral indicia diametrically opposed as previously described, it is possible to expose all the neutral indicia after all the display indicia are exposed in one movement by rotating the frame member 180° in a transverse direction relative to the normal rotation of the spherical member. During game play, the spherical members rotate 360° about an axis of rotation parallel to the projecting axles and the detenting ball orbits around the same axis. Conversely, during the reset operation, the frame member is rotated in a linear direction relative to the spherical member axles at which time the spherical member remains stationary relative to the frame member. The detenting ball remains substantially at the bottom of the spherical member during the rotational movement of the frame. For example, with reference to FIG. 5, ball 96, disposed in portion 88, is translatable from one portion 88 to another portion 92 of chamber 84 during the reset rotation operation. The translation of ball 96 is caused by rotation of the frame member 12 in a perpendicular direction relative to the normal rotation of the spherical member 82. When the frame member 12 is rotated 180°, the spherical member 82 remains stationary relative to the frame member and ball 96 translates from portion 88 through a central cavity of chamber 84 to portion 92. When ball 96 is in any of the chamber portions 86, 88, 90 or 92, it will always move to the diametrically opposed chamber portion 90, 92, 86 and 88, respectively, when the frame member is rotated 180° in the manner as previously described.

In a game apparatus having the spherical members 82 as shown in FIG. 5, a game of tic-tac-toe can be played easily. Spherical member 82 would define four displays of indicia. The first display could be "X" design, the second display could be an "O" design, while the third and fourth displays are of a neutral design. When a game of tic-tac-toe is finished, the players simply turns the game apparatus completely over and all neutral designs are once again showing. Therefore, the players need not reset each piece after the finish of every game. In an alternative embodiment, spherical member 82 could define four unique displays of indicia.

Many variations of different games can be played on a game apparatus with rotating spherical members as described. Games with an object of completely filling a row or rows with identical displays of indicia either vertically, horizontally or diagonally, such as tic-tac-toe, may simply be played by the rotation of the spherical members to the desired display. For example, a game of skill can be played in which the players alternately rotate the spherical members having 3 displays of indicia through a maximum arc of 120°. The first player to fill a row with their display of indicia is the game winner.

A second game employing the present invention is a game of chance in which the players spin the spherical member through an arc in excess of 360° for several revolutions before the spherical member comes to rest. The players attempt to have their display stop at the top position of the frame member with the first player to fill a row with their display being the game winner. A third game of chance is one similarly described above except that the players attempt to fill the entire game board by alternately spinning the spherical members through an arc of 360° for several revolutions.

Additional games are likewise available. Using a game apparatus having an 8×8 matrix with the spherical members defining two displays of indicia different from identical third and fourth displays of indicia as previously described, players can play the game named "Othello ®" by simply rotating the spherical members to their corresponding displays of indicia. The unturned spherical members between any two spherical members having like displays of indicia showing, either vertically, horizontally, or diagonally are likewise rotated until all of the spherical members have been turned from a neutral position to a first or second display. The player having the most displays of indicia visible after all spherical members have been turned over is the game winner. Since the third and fourth displays are neutral and are 180° disposed from the first and second displays, the players simply turn the game apparatus 180° over to begin a new game. Reset of the game pieces is therefore not necessary. Other variations of games may be suitably thought of.

In light of the foregoing, it should be apparent that many variations are possible within the scope of the present invention. Accordingly, the foregoing drawings, discussion and description are merely meant to be illustrative of particular embodiments of the invention and not limitations upon the practice thereof. It is the following claims including all equivalents which define the scope of my invention.

I claim:

1. A game apparatus comprising:

(a) a plurality of spherical members, each having a pair of diametrically opposed axles projecting therefrom so that each spherical member is rotatable about an axis of rotation parallel to said pair of axles, each spherical member further including a plurality of indicia disposed about the equatorial periphery thereof and wherein each of said spherical members is at least partially hollow and defines a substantially unobstructed chamber therein, said chamber including at least two contiguous portions, each portion corresponding to a unique display of indicia;

(b) a frame member including a plurality of stations, each station configured to receive one of said spherical members therein, said frame member including a generally vertical wall extending around the periphery of said plurality of stations to define an open top side and an open bottom side so that said indicia are visually perceptible from either side of said frame member, said frame member further including bearing means for supporting each of said axles so that the spherical member is freely rotatable in its corresponding station, whereby rotation of said spherical member allows for a selectable display of a particular indicium; and (c) detent means for biasing the rotation of said spherical member to a preselected position comprising a ball disposed in said chamber of each of said spherical members and translatable from one portion of said chamber to another portion of said chamber, the translation of said ball caused by the rotation of said spherical member to said position corresponding to a display of indicium and wherein said spherical member is configured so that said ball is operative to translate from said one contiguous portion of said chamber to a diametrically opposed contiguous portion of said chamber without axial rotation of the spherical member upon rotation of said frame member in a direction perpendicular to the rotation of said spherical member.

2. A game apparatus as in claim 1, wherein said plurality of spherical members define at least a 3×3 matrix of rows and columns, said rows being perpendicularly disposed in relation to said columns.

3. A game apparatus as in claim 1, wherein each of said spherical members includes four indicia, wherein the first indicium is of a first design, the second indicium is of a second design, the third and fourth indicia are of a third design, said first and second displays of indicia spaced at 90° intervals from one another and said third and fourth displays are spaced at 180° intervals from said first and second displays respectively.

4. A game apparatus as in claim 1, wherein each of said spherical members includes four different indicia disposed about said equatorial periphery, wherein the first indicium is of a first design, the second indicium is of a second design, the third indicium is of a third design, and the fourth indicium is of a fourth design, said indicia spaced equidistantly around said equatorial periphery.

5. A game apparatus as in claim 1, wherein said plurality of indicia includes tactile symbols for aiding the sight impaired in the identification of each indicium.

6. A game apparatus as in claim 1, wherein said frame member further includes counter means operative to indicate a player's score.

7. A game apparatus as in claim 6, wherein said counter means comprises a disk-shaped member having reversibly opposed embossed characters whereby a player is able to determine an opponent's score by reading the embossed characters on said disc.

8. A game apparatus as in claim 1, wherein said chamber further includes ridges generally perpendicular to the equatorial periphery, the number of ridges corresponding to the number of displays of indicia.

9. A game apparatus as in claim 1, wherein said detent means is operative to restrict the biasing of said spherical member upon rotation of said frame member in a direction perpendicular to the rotation of said spherical member.

10. A game apparatus comprising:

(a) a plurality of spherical members, each having a pair of diametrically opposed axles projecting therefrom so that said spherical members are freely rotatable about an axis of rotation parallel to said pair of axles, each spherical member including four displays of indicia disposed about the equatorial periphery thereof and wherein each of said spherical members is at last partially hollow and defines a substantially unobstructed chamber therein, said chamber including four contiguous portions thereof, each portion corresponding to a unique display of indicium;

(b) a frame member including a plurality of stations, each station configured to receive one of said spherical members therein, and further including bearing means for supporting each of said axles so that each of the spherical members is rotatable in its corresponding station, whereby rotation of said spherical member allows for a selectable display of a particular indicium; and (c) detent means for biasing the rotation of said spherical member to a preselected position comprising a ball disposed in said chamber of said spherical member and translatable form one portion of said chamber to another portion of said chamber, the translation of said ball caused by the rotation of said spherical member to said position corresponding to a display of indicium and wherein said ball is operative to translate from one contiguous portion of said chamber to a diametrically opposed contiguous portion upon rotation of said frame member 180 degrees in a direction perpendicular to the rotation of said spherical member.

11. A game apparatus as in claim 11, wherein each of said spherical members includes fours displays of indicia, wherein the first display of indicium is of a first design, the second display is of a second design, the third and fourth displays are of a third design, said first and second displays of indicia spaced at 90° intervals from one another and said third and fourth displays are spaced at 180° intervals from said first and second displays respectively.

12. A game apparatus as in claim 10, wherein each of said spherical members includes four different indicia disposed about said equatorial periphery, wherein the first indicium is of a first design, the second indicium is of a second design, the third indicium is of a third design, and the fourth indicium is of a fourth design, said indicia spaced equidistantly around said equatorial periphery.

13. A game apparatus as in claim 10, wherein said plurality of indicia includes tactile symbols for aiding the sight impaired in the identification of each indicium.

14. A game apparatus as in claim 10, wherein said frame member further includes a counter means operative to indicate a player's score.

15. A game apparatus as in claim 14, wherein said counter means comprises a disk-shaped member having reversibly opposed embossed characters whereby a player is able to determine an opponent's score by reading the embossed characters on said disc.

16. A game apparatus as in claim 10, wherein said frame member further includes a generally vertical wall extending around periphery of said plurality of stations, said plurality of stations disposed generally at the midpoint of said wall so as to define an open top side and an open bottom side so that said indicia are visually perceptible from either of said sides when said frame member is rotated in said direction.

17. A game apparatus as in claim 10, wherein said detent means is operative to restrict the biasing of said spherical member upon rotation of said frame member in a direction perpendicular to the rotation of said spherical member.

18. A game apparatus comprising:

(a) a plurality of spherical members, each having a pair of diametrically opposed axles projecting therefrom and a plurality of indicia disposed about the equatorial periphery thereof, said spherical members freely rotatable about an axis of rotation parallel to said pair of axles;

(b) a frame member including a plurality of stations, each station configured to receive one of said spherical members therein, said frame member including counter means operative to indicate a player's score comprising a disk-shaped member having reversibly opposed, embossed characters so that a player can determine an opponent's score by reading the embossed characters on said disk, said frame member further including bearing means for supporting each of said axles so that the spherical member is freely rotatable in its corresponding station, whereby rotation of said spherical member allows for selectable display of a particular indicium; and (c) detent means for biasing the rotation of said spherical member to a preselective position, said position corresponding to a display of indicium.

* * * * *

UNITED STATES PATENT AND TRADEMARK OFFICE

CERTIFICATE OF CORRECTION

PATENT NO. : 4,890,845

DATED : January 2, 1990

INVENTOR(S) : Gatewood

It is certified that error appears in the above-identified patent and that said Letters Patent is hereby corrected as shown below:

Column 9, line 26, "claim 11" should be --claim 10--.

Signed and Sealed this

Twelfth Day of March, 1991

*Attest:*

HARRY F. MANBECK, JR.

*Attesting Officer*

*Commissioner of Patents and Trademarks*